US006206713B1

(12) United States Patent
Baertsoen et al.

(10) Patent No.: US 6,206,713 B1
(45) Date of Patent: Mar. 27, 2001

(54) PCB ZERO-INSERTION-FORCE CONNECTOR

(75) Inventors: Peter Baertsoen, Zulte; Jacques Longueville, Oostkamp, both of (BE)

(73) Assignee: Tyco Electronics Logistics AG, Steinach (CH)

( * ) Notice: Subject to any disclaimer, the term of this patent is extended or adjusted under 35 U.S.C. 154(b) by 0 days.

(21) Appl. No.: 09/116,849

(22) Filed: Jul. 16, 1998

(30) Foreign Application Priority Data

Jul. 16, 1997 (DE) ..... 197 30 484

(51) Int. Cl.[7] ..... H01R 13/62
(52) U.S. Cl. ..... 439/260; 439/571
(58) Field of Search ..... 439/259, 260, 439/261, 267, 62, 67, 77, 571, 328, 108

(56) References Cited

U.S. PATENT DOCUMENTS 3,130,351 4/1964 Giel .
3,665,370 * 5/1972 Hartmann ..... 439/260
4,556,268 * 12/1985 Noschese ..... 439/267

* cited by examiner

*Primary Examiner*—Lincoln Donovan
*Assistant Examiner*—Eugene G. Byrd
(74) *Attorney, Agent, or Firm*—Herbert L. Lerner; Laurence A. Greenbe; Verner H. Stemer

(57) ABSTRACT

The PCB zero-insertion-force connector has a housing and two connector halves inside the housing. The connector halves can be swiveled toward each other and away from each other. In a mounting position, in which they are swiveled away from each other, the connector halves allow the insertion of a PCB which is to be brought connected with the PCB upon which the housing is mounted. In a connecting position, the connector halves are swiveled toward each other. The connector halves of the PCB zero-insertion-force connector are formed of a plurality of connector-half modules which are arranged in series alongside one another.

7 Claims, 4 Drawing Sheets

100
101
10
101
101
13
12
11
110-2
110-1

PCB ZERO-INSERTION-FORCE CONNECTOR

BACKGROUND OF THE INVENTION

Field of the Invention

The present invention relates to circuit board connectors and, more specifically, to a PCB zero-insertion-force connector with a housing and two connector halves accommodated in the housing which are swivelable toward each other and away from each other. In a mounting position, in which they are swiveled away from each other, the connector halves allow the insertion of one of the PCBs to be brought into contact with each other. In a connecting position, in which they are swiveled towards each other, they establish a contact with the inserted PCB.

Such PCB zero-insertion-force connectors are known, for example, from U.S. Pat. No. 3,130,351 to George Giel. The connectors serve the purpose of connecting two PCBs electrically and mechanically to each other essentially without any force. The connectors are generally used, inter alia, to connect a first PCB simply and without any danger of force damage essentially perpendicularly onto a second PCB (for example a so-called backplane or motherboard). The resulting electrical and mechanical connection is secure and reliable.

The number of contacts which are to be connected with one another when connecting PCBs differs from case to case and may vary considerably. Accordingly, the PCB zero-insertion-force connectors connecting the PCBs are also to be designed for different numbers of contacts.

For this reason, the PCB zero-insertion-force connectors are to be offered in different lengths, the various lengths preferably corresponding to an integral multiple of a basic length (for example 25 mm).

However, the manufacture of PCB zero-insertion-force connectors of different lengths involves relatively high expenditure, because individual parts of different sizes have to be produced and assembled (preferably on one and the same apparatuses).

This problem could be obviated if only PCB zero-insertion-force connectors of the basic length were manufactured and these were constructed in such a way that they can be combined to give any overall length by fitting them next to one another. However, such PCB zero-insertion-force connectors are difficult to process, at least whenever a number of them are to be combined to give a larger PCB zero-insertion-force connector. Processing requires an increased number of working steps and an extreme degree of precision.

SUMMARY OF THE INVENTION

It is accordingly an object of the invention to provide a PCB zero-insertion force plug connector, which overcomes the above-mentioned disadvantages of the prior art devices and methods of this general type and which allows the connector to be both manufactured in a simple manner and processed in a simple manner, and that this is so even if the PCB zero-insertion-force connector is to be variable in its dimensions.

With the foregoing and other objects in view there is provided, in accordance with the invention, a PCB zero-insertion-force connector, comprising:

a housing;

two connector halves accommodated in the housing and being selectively swivelable toward each other into a connecting position and away from each other into a mounting position;

the connector halves, in the mounting position thereof, being adapted to receive therebetween a PCB and, in the connecting position thereof, contacting and mechanically retaining the PCB;

each of the connector halves comprising a plurality of connector-half modules disposed in series alongside one another.

In accordance with an added feature of the invention, the connector-half modules of the connector halves are identical modules.

In accordance with an additional feature of the invention, a length of each of the connector-half modules defines a unit length increment within which a length of the PCB zero-insertion-force connector is variable.

In accordance with another feature of the invention, the housing is formed with intermediate walls subdividing the housing along a length thereof into chambers, the chambers being shaped and dimensioned for receiving two connector-half modules in mutually opposite alignment, whereby one of the two connector-half modules is a connector-half module of the first connector half and the other connector-half module is a connector-half module of the second connector half.

In accordance with a further feature of the invention, the connector-half modules and/or the housing are designed such that individual the connector-half modules can be brought into engagement with the housing during an assembly operation allowing mutually opposite the connector-half modules to be selectively swiveled toward each other and away from each other.

In accordance with again a further feature of the invention, there is provided a swivel mechanism actuatable externally of the housing, and two rod-like elements extending from the swivel mechanism into an interior of the housing and extending through the housing over an entire length thereof in direct vicinity of each of the connector halves.

In accordance with a concomitant feature of the invention, the rod-like elements are formed and disposed such that they are capable of coming into contact with the connector-half modules in such a way that the connector-half modules are forced to swivel upon a pivoting movement of the rod-like elements.

If the connector-half modules are identically configured, irrespective of their position within the PCB zero-insertion-force connector, then the PCB zero-insertion-force connector can be constructed from a minimal number of different types of components. Specifically, there is required a variable number of identical connector-half modules, the housing and a swivel mechanism for the swiveling (apart and together) of the connector halves. It is therefore only the relatively simple (variable length) housing that is adapted to any appreciable extent to the respective length of the PCB zero-insertion-force connector. The PCB zero-insertion-force connector according to the invention can therefore be manufactured extremely simply, even with variable dimensions of the connector.

Furthermore, the connector can also be processed in a very simple manner. This is because the PCB zero-insertion-force connector according to the invention is a contiguous unit which can be assembled in a minimal number of operations and without increased requirements for precision with respect to one of the PCBs to be connected.

Consequently, the invention provides for a PCB zero-insertion-force connector which can be both manufactured in a simple manner and processed in a simple manner, even though it is variable in its dimensions.

Other features which are considered as characteristic for the invention are set forth in the appended claims.

Although the invention is illustrated and described herein as embodied in a PCB zero-insertion-force connector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

The PCB zero-insertion-force connector described in more detail below provides for an electrical and mechanical connection between two PCBs that are oriented essentially perpendicularly with respect to each other (an additional board is plugged perpendicularly onto a first board). However, use of the PCB zero-insertion-force connector according to the invention is not restricted to such applications. It will be understood by those skilled in the art that the PCBs which can be connected by PCB zero-insertion-force connectors of the type described may, in principle, assume any relative positions.

Figure 4:
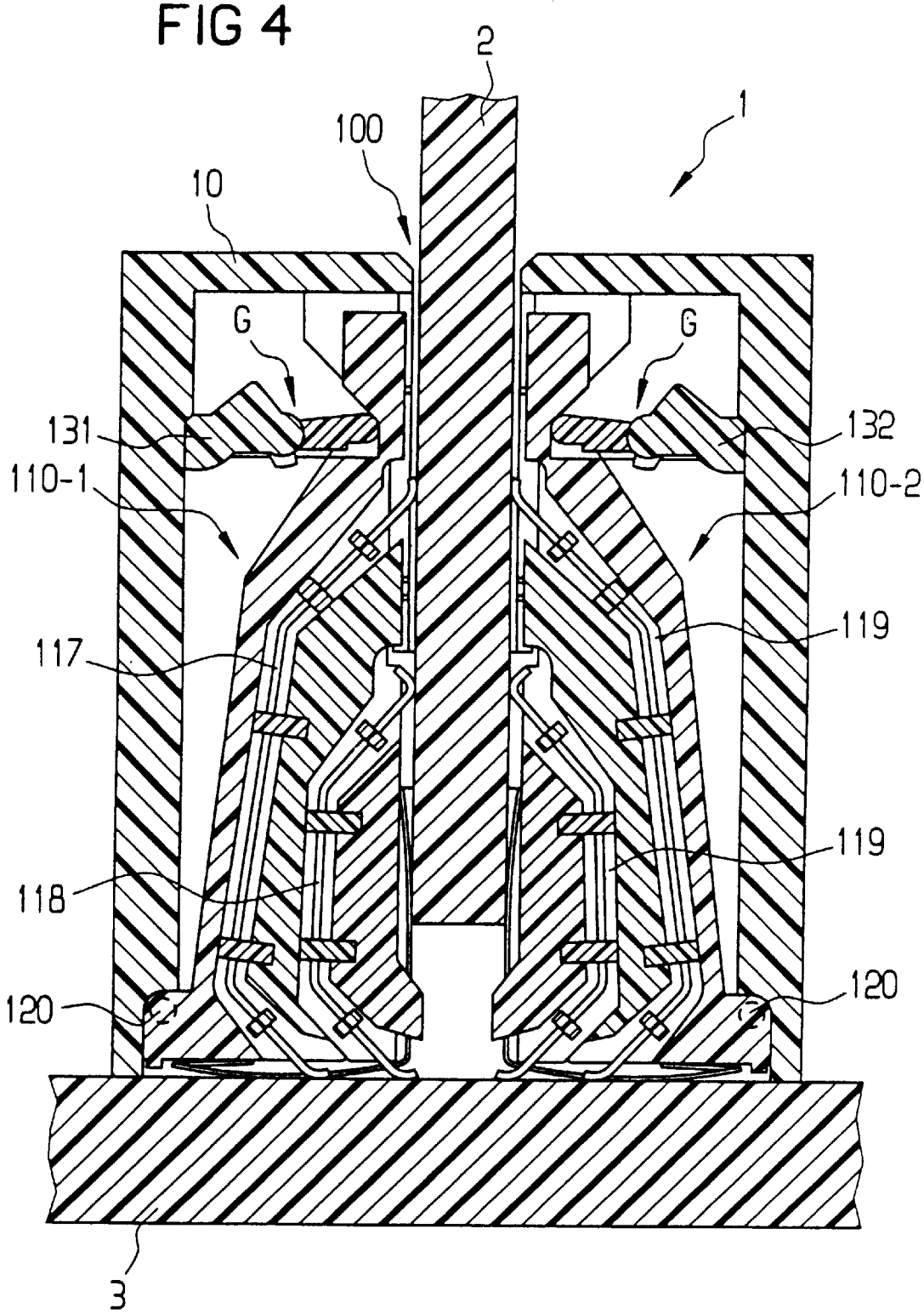
FIG. 4 is a sectional view taken through the PCB zero-force-insertion connector of FIG. 1, in a position connecting two PCBs to each other.

Referring now to the figures of the drawing in detail and first, particularly, to FIG. 4 thereof, there is seen a PCB zero-insertion-force connector generally designated by the reference numeral 1. The PCBs which are to be connected by the PCB zero-insertion-force connector 1 are a first PCB 2 and a second PCB 3, whereby the first PCB 2 can be plugged essentially perpendicularly onto the second PCB 3. PCBs of the type of the second PCB 3 are, for example, the so-called backplanes. The PCBs which can be plugged onto the latter, of the type of the first PCB 2, are frequently referred to as insert cards, corresponding to the way in which they are mounted.

Figure 1:
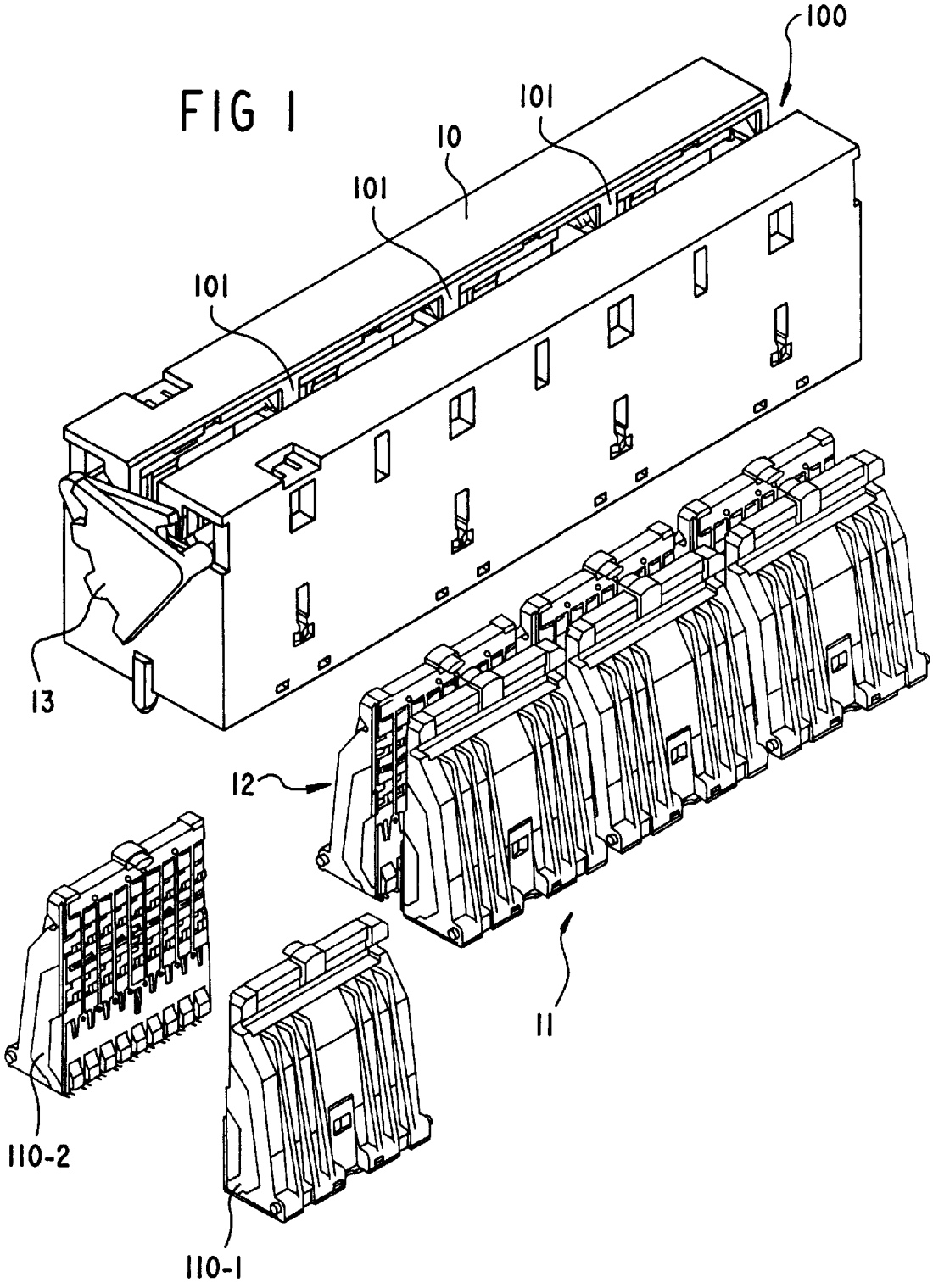
FIG. 1 is an exploded perspective view of an exemplary embodiment of the PCB zero-insertion-force connector according to the invention.

With particular reference to FIGS. 1 and 4, the PCB zero-insertion-force connector comprises a housing 10, a first connector half 11, a second connector half 12 and a swivel mechanism 13. The connector halves 11 and 12 for their part respectively comprise a multiplicity of connector-half modules 110-1 and 110-2 arranged in series alongside one another.

The connector-half modules 110-1 and 110-2 can be inserted into the housing 10 from the underside of the latter, represented underneath in FIG. 1.

The completely assembled PCB zero-insertion-force connector 1 (in the exemplary embodiment it is only the housing 10 thereof) is securely mounted on the second PCB 3. The first PCB 2 can then be inserted, as can be seen in particular from FIG. 4, through an elongate opening 100 on the upper side of the housing 10, between the connector halves 11 and 12.

The elongate opening 100 is dimensioned in such a way that only PCBs which do not represent any risk of damage—at least with respect to their dimensions—to the PCB zero-insertion-force connector can be inserted through.

By the actuation of the swivel mechanism 13, the first connector half 11 and the second connector half 12 are able (even in the state in which the PCB zero-insertion-force connector 1 is mounted on the second PCB 3) to be swiveled or swung synchronously toward each other and away from each other in a way to be described later in more detail. In the example under consideration here, this takes place in a particularly simple and easy manner, because the connector-half modules 110-1 and 110-2 and the second PCB 3 are not fastened to one another.

The swiveling apart of the connector halves 11 and 12 causes them to move away from each other at their upper end, according to the representation in FIG. 4, whereby the intermediate space existing between the connector halves 11 and 12 is widened there. If and for as long as the intermediate space is widened, the first PCB 2 can be inserted into it. This position of the PCB zero-insertion-force connector 1 or of the connector halves 11 and 12 of the same is therefore referred to as the mounting position.

The swiveling together of the connector halves 11 and 12 causes the latter to move toward each other at their upper end, according to the representation in FIG. 4, whereby the intermediate space between the connector halves 11 and 12 is narrowed. If and for as long as the slit is narrowed in this way, the first PCB 2 possibly inserted therein is clamped more or less securely between the connector halves 11 and 12 and thereby comes into electrical and mechanical contact with the second PCB 3 via the PCB zero-insertion-force connector 1. This state is represented in FIG. 4.

The construction of a connector-half module 110-1 or 110-2 will now be described with reference to FIGS. 2 and 3. All the connector-half modules, i.e. both the connector-half modules 110-1 of the first connector half 11 and the connector-half modules 110-2 of the second connector half 12, have exactly the same construction in the example under consideration.

The connector-half modules have a multipart construction. They comprise an insulating outer part 111, a layer 112 of contact elements 117, lying next to one another and held together by insulating elements, an insulating central part 113, a further layer 114 of contact elements 118, lying next to one another and held together by insulating elements, an insulating inner part 115 and a holding part 116. The individual parts are joined together by just placing them one on the other and clamping together by the holding part 116.

The contact elements 117 of the layer of contact elements 112 and the contact elements 118 of the layer of contact elements 114 are elongate electrically conducting elements, via which contact points of the first PCB 2 and contact points of the second PCB 3 can be electrically connected with one another (cf. FIG. 4). The elements 112 and 114 are flexible contact elements, which in the relaxed state protrude with both ends out of the connector-half modules 110-1 and 110-2. The protruding end portions, in the exemplary embodiment, are adapted to contact board surface contacts.

Consequently, PCBs of which both the one and the other surface contacts have contact elements to be connected can be connected by the PCB zero-insertion-force connector described. Signal reflections, which are otherwise observed at the contact points of conventional PCB zero-insertion-force connectors and other plug-in connectors, can be reduced to a minimum with the just-described system. Apart from this, the mounting of the PCB zero-insertion-force connector onto the second PCB 3 is also considerably simplified as a result: this is so since, as already mentioned above, all that is necessary is to fasten the housing 10 of the PCB zero-insertion-force connector on the second PCB 3. In addition, the use of surface contacts as PCB contact points provides more freedom in the arrangement and density of the contact points as well.

Each of the contact elements 117 and 118 runs through the respective connector-half module in a channel 119, which is closed on all sides and, in the state of the PCB zero-insertion-force connector in which it is properly connecting two PCBs, extends from the surface of the one PCB right through to the surface of the second PCB. As a result, the contact elements 117 and 118 can be completely shielded over their entire length.

The ends of the contact elements 117 and 118 protruding from the connector-half modules 110-1 and 110-2 in the relaxed state are flexibly pressed back into the channels 119 when the contact elements are pressed against a PCB with which contact is to be established. The contact elements 117 and 118 cannot at the same time be displaced along the channels 119, however, since they are fixed non-displaceably in the longitudinal direction by (electrically insulating) connecting parts, which hold the contact elements of the already mentioned layers of contact elements 112 and 114 together, or by spacers or by molded-on lugs or the like. Rather, the contact elements 117 and 118 are flexibly bent when they are brought into the connecting position, the freedom of movement of the contact elements being restricted, however, in a way governed by their construction, their form and their arrangement, in such a way that the only movements which can take place are those in which the distance between the contact elements and one or more channel walls determining the impedance of the connection remains essentially unchanged. This ensures that, under all circumstances, i.e. even if the PCB zero-insertion-force connector and/or the PCBs to be brought into connection are affected by certain tolerances, the same standard of highgrade connections can always be established between the PCBs to be connected.

The connecting-half modules designed as described are inserted into the housing 10 from the underside of the latter in the orientation which can be seen from FIGS. 1 and 4. The housing 10 is subdivided by intermediate walls 101 in its length into a plurality of chambers of equal size. These chambers are dimensioned in such way that a pair of mutually opposite connector-half modules can in each case be inserted there and that connector-half modules which are neighboring with respect to the longitudinal direction, i.e. the connector-half modules forming one connector half, can be arranged in series alongside one another virtually without any gaps. Of the mutually opposite connector-half modules, their inner parts 115 are in each case opposite one another.

The length of the chambers, and consequently also the length of the connector-half modules, preferably corresponds to the unit of length in increments of which the length of the PCB zero-insertion-force connector is possibly to be variable.

Figure 2:
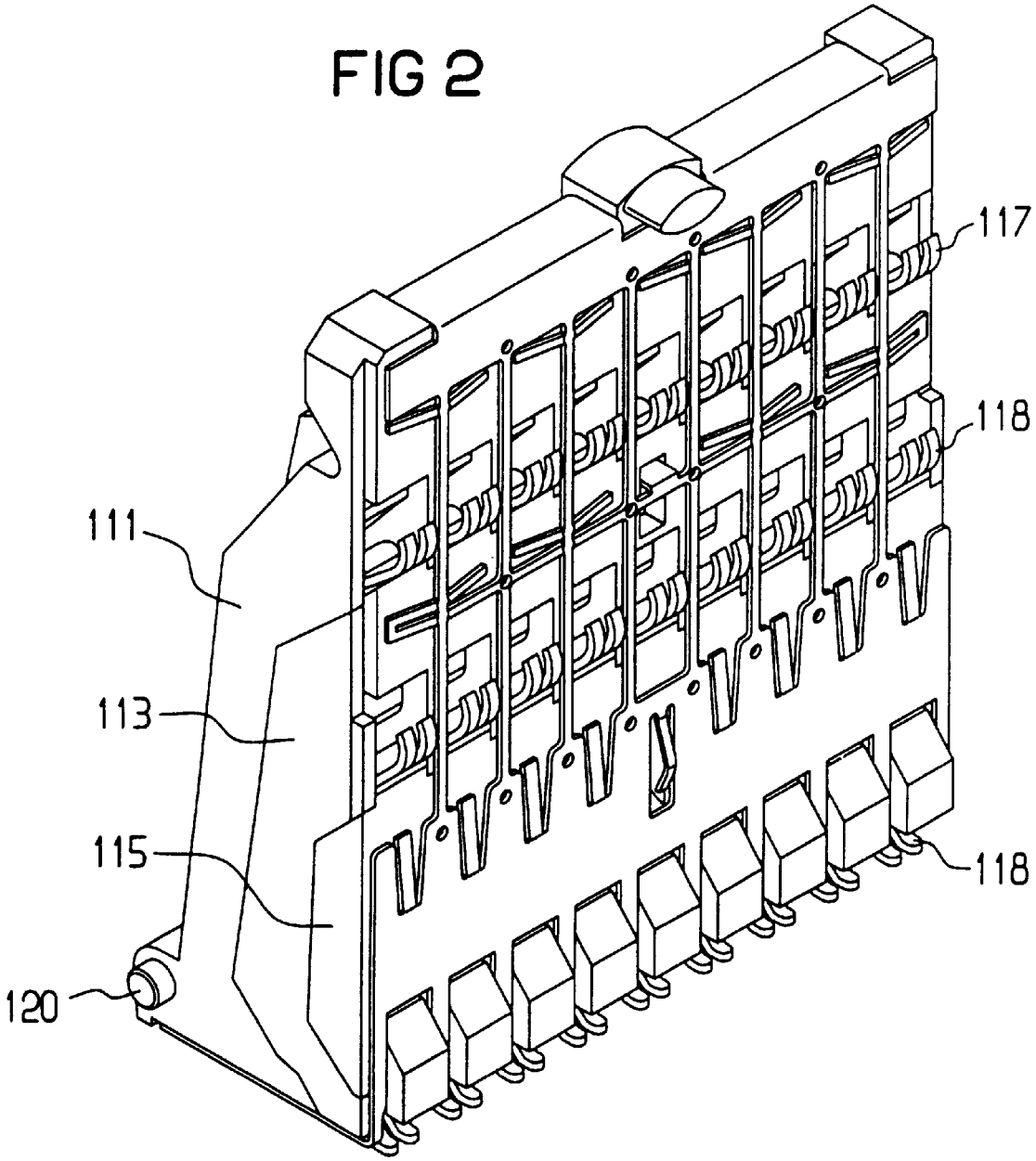
FIG. 2 is a perspective view of a connector-half module of the PCB zero-insertion-force connector according to FIG. 1.
Figure 3:
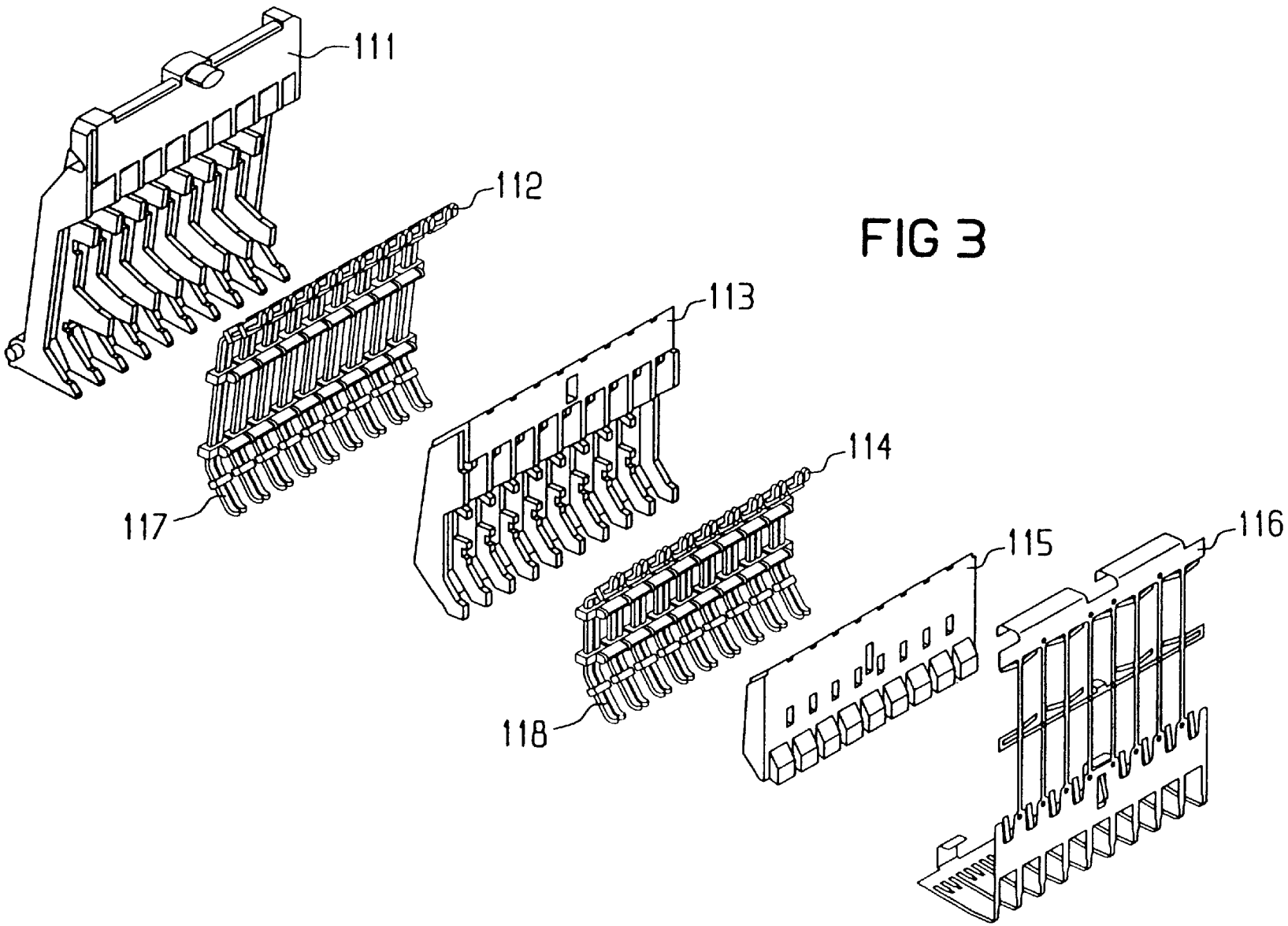
FIG. 3 is a laterally exploded, perspective view of the connector-half module according to FIG. 2.

With reference to FIGS. 1 to 3, the outer parts 111 of the connector-half modules have in each case on the mutually opposite wide sides a lug 120, which is introduced into groove-like recesses in the end walls of the housing 10 and the intermediate walls 101 of the same when the connector-half modules are inserted. These lugs serve—as will be described in the following—as an axis about which the connector halves or the connector-half modules forming them can be swiveled toward each other and away from each other.

In the completely assembled state of the PCB zero-insertion-force connector, its housing 10 houses not only the connector-half modules 110-1 and 110-2 but also two rod-like elements 131 and 132 belonging to the swivel mechanism 13. These elements, referred to hereafter for the sake of simplicity as rods, run from the part of the swivel mechanism 13 outside the housing 10, shown in FIG. 1, into the interior of the housing 10 and run through the latter (the clearances between the lateral housing walls and the respectively assigned connector-half module) essentially over the entire length. The rods 131 and 132 are divided in two in width, essentially over their entire length, the two parts being connected to each other in such a jointed manner that each of the rods 131 and 132 can act as a toggle lever.

In the state shown in FIG. 4, the toggle levers are in a stable (self-locking) position, which they can leave only if the points at which they are jointed, denoted by G, are moved upward. The rods butt with their one part (arm) against the housing 10 and at the same time press by their respectively other arm against the upper portions of the connector-half modules, whereby the latter are held in a position swiveled toward each other about the lugs 120. In this position of the PCB zero-insertion-force connector referred to as the connecting position, the first PCB inserted into said connector is clamped more or less securely between the connector halves and is thereby properly contacted. At the same time, the connector-half modules are pressed against the second PCB 3. The contact elements 117 and 118 of the connector-half modules protruding from the channels 119 in the relaxed state are pressed back into the channels and, in their endeavour to return to the relaxed initial position, press flexibly against the surface contacts of the PCBs to be brought into connection, whereby a good and reliable electrical connection is obtained between them.

If the part of the swivel mechanism 13 arranged outside the housing 10, as shown in FIG. 1, is actuated, in order to bring the PCB zero-insertion-force connector in the connecting position into the mounting position, the arm of the rods 131 and 132 respectively butting against the housing 10 is thereby swiveled counterclockwise (rod 131) or clockwise (rod 132). The arm respectively butting against the connector-half module is taken along (pulled along) by the connector-half module and consequently meets the prerequisite that the connector-half modules initially pressed toward each other can be swiveled away from each other about their lugs 120. The force required for the swiveling movement is applied by the contact elements 117 and 118 of the connector-half modules. This is so since, in the connecting position shown in FIG. 4, said contact elements are flexibly pressed back into the channels 119 and endeavor to return to their relaxed position, in which they protrude out of the channels 119. As a result, the connector-half modules are swiveled away from each other automatically—although no connection exists between them and the rods 131 and 132—to the extent allowed by the change in position of the respective rod.

The rods are at no time in connection with the connector-half modules. They are separate individual parts.

The modular construction of the PCB zero-insertion-force connector described allows it to be produced in different lengths in an extremely simple way. Of the components from which the PCB zero-insertion-force connector is assembled, only the housing 10 and the rods 131 and 132 have to be adapted to the respective length of the PCB zero-insertion-force connector. If the variations in length of the PCB zero-insertion-force connector take place in increments which correspond to the length of one connector-half module, the comparatively complicated to manufacture connector-half modules can remain entirely unchanged; all that has to be changed then is the number of connector-half modules to be inserted into the respective housings.

The manufacture of the housing 10 in different lengths is a relatively easy to accomplish task because of the simple construction of the housing. The manufacture of rods 131 and 132 of different lengths is also extremely simple and uncomplicated. It is only necessary for them to be produced in sufficient length and they can then be cut to any desired length without any problem.

The PCB zero-insertion-force connector described can also be adapted very simply to different thicknesses of the (first) PCB to be inserted into it. For this purpose, only the housing 10 has to be changed: it has to be widened to such an extent that the intermediate space between mutually opposite connector-half modules approximately corresponds in their connecting position to the thickness of the PCB to be inserted in between. Even in this case, the connector-half modules do not require any modification whatsoever.

The components of the PCB zero-insertion-force connector described can be joined together irrespective of the length and width of the latter to give a contiguous whole. During the processing of the PCB zero-insertion-force connector, therefore, only a single part has to be handled. Processing and handling can therefore always be carried out simply and quickly.

To sum up, the PCB zero-insertion-force connector described above can be manufactured in a simple manner and processed in a simple manner under all circumstances, i.e. even if it is to be variable in its dimensions.

We claim:

1. A PCB zero-insertion-force connector, comprising:

a housing;

two connector halves accommodated in said housing and being selectively swivelable toward each other into a connecting position and away from each other into a mounting position;

said connector halves, in the mounting position thereof, being adapted to receive therebetween a PCB and, in the connecting position thereof, contacting and mechanically retaining the PCB;

each of said connector halves comprising a plurality of connector-half modules longitudinally disposed in series alongside one another substantially without gaps therebetween.

2. The connector according to claim 1, wherein said connector-half modules of said connector halves are identical modules.

3. The connector according to claim 1, wherein a length of each of said connector-half modules defines a unit length increment within which a length of the PCB zero-insertion-force connector is variable.

4. The connector according to claim 1, wherein said housing is formed with intermediate walls subdividing said housing along a length thereof into chambers, said chambers being shaped and dimensioned for receiving two connector-half modules in mutually opposite alignment, whereby one of the two connector-half modules is a connector-half module of said first connector half and the other connector-half module is a connector-half module of said second connector half.

5. The connector according to claim 1, wherein one of said connector-half modules and said housing are designed such that individual said connector-half modules can be brought into engagement with said housing during an assembly operation allowing mutually opposite said connector-half modules to be selectively swiveled toward each other and away from each other.

6. The connector according to claim 1, which further comprises a swivel mechanism actuatable externally of said housing, and two rod-like elements extending from said swivel mechanism into an interior of said housing and extending through said housing over an entire length thereof in direct vicinity of each of said connector halves.

7. The connector according to claim 6, wherein said rod-like elements are formed and disposed such that they are capable of coming into contact with said connector-half modules in such a way that said connector-half modules are forced to swivel upon a pivoting movement of said rod-like elements.

* * * * *